United States Patent [19]

Stalder

[11] 4,009,562

[45] Mar. 1, 1977

[54] METHOD AND APPARATUS FOR ELIMINATING IMPURITIES FROM AN OPEN-END SPINNING MACHINE

[75] Inventor: Herbert Stalder, Winterthur, Switzerland

[73] Assignee: Rieter Machine Works, Ltd., Winterthur, Switzerland

[22] Filed: Feb. 9, 1976

[21] Appl. No.: 656,202

[30] Foreign Application Priority Data

Feb. 14, 1975 Switzerland ..... 1859/75

[52] U.S. Cl. ..... 57/56; 57/58.95; 57/156

[51] Int. Cl.[2] ..... D01H 11/00; D01H 1/12

[58] Field of Search ..... 57/34 R, 56, 58.89–58.95, 57/156

[56] References Cited

UNITED STATES PATENTS

| | | | |
|---|---|---|---|
| 3,777,466 | 12/1973 | Kobele et al. | 57/58.89 |
| 3,792,575 | 2/1974 | Doudlebsky et al. | 57/56 |
| 3,797,218 | 3/1974 | Landwehrkamp et al. | 57/58.95 X |
| 3,800,521 | 4/1974 | Doudlebsky et al. | 57/58.95 |
| 3,839,764 | 10/1974 | Clayton | 57/56 X |
| 3,884,027 | 5/1975 | Schumann et al. | 57/58.95 X |
| 3,892,063 | 7/1975 | Doudlebsky et al. | 57/56 |

*Primary Examiner*—Donald E. Watkins
*Attorney, Agent, or Firm*—Kenyon & Kenyon Reilly Carr & Chapin

[57] ABSTRACT

An air duct is located opposite a separating opening which opens into the space containing the fiber opening roll so as to receive impurities centrifuged from the opening roll. The separating opening has a wall which forms an acute angle with the opposite wall of the duct so that the impurities can be deflected off the duct wall into the same direction as the air flow in the duct. The duct is narrowed downstream of this point in order to accelerate the air flow and entrained impurities out of the machine via a suction duct. This also stretches out any loose fibers in the flow for rapid removal in order to prevent clogging of the suction duct.

11 Claims, 1 Drawing Figure

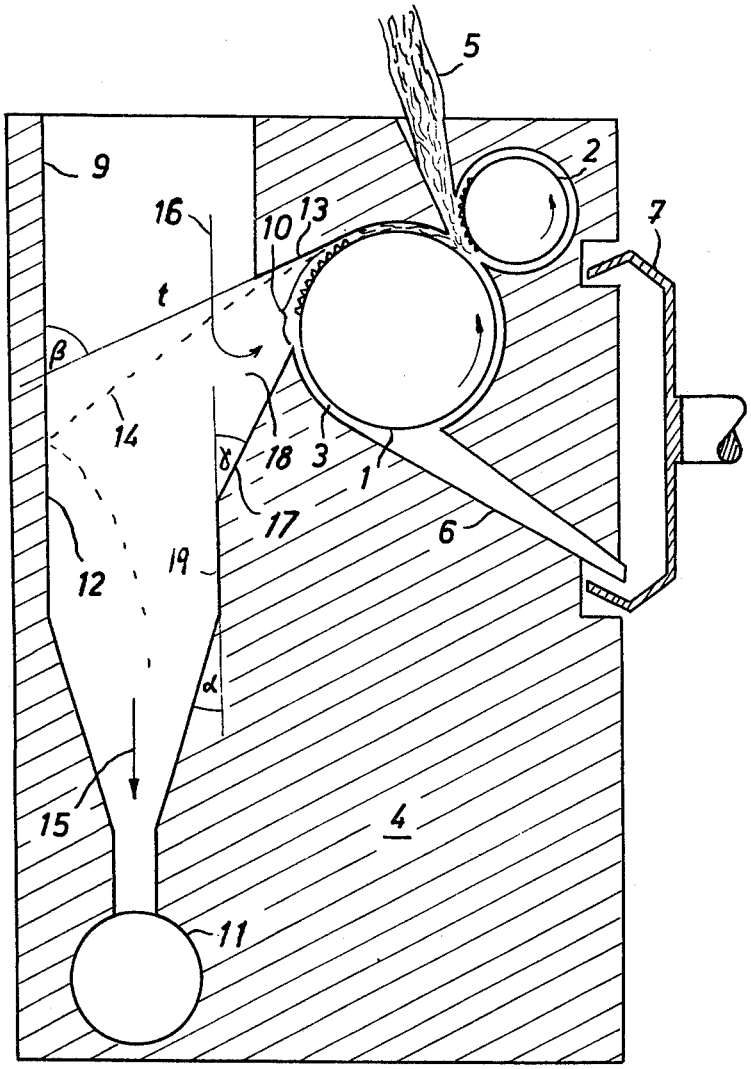
5
2
7
9
16
10
13
t
β
14
18
3
1
γ
17
6
12
19
α
15
4
11

METHOD AND APPARATUS FOR ELIMINATING IMPURITIES FROM AN OPEN-END SPINNING MACHINE

Heretofore, various open-end spinning machines have been known wherein a sliver is opened into fibers and the fibers spun into yarn. In many instances, the delivered sliver contains impurities which, if retained in the fibers being processed, may lead to a reduction in the quality of the produced yarn. Accordingly, many of the known open-end spinning machines have been provided with devices for eliminating the impurities during processing. For example, British Pat. No. 1,385,513 describes a device for eliminating impurities separated at an opening roll of the spinning machine in which the impurities are ejected by the opening roll via a cleaning opening and are reflected by a wall adjacent to this opening. Subsequently, the impurities, which necessarily contain some lost fibers, drop into a waste collecting chamber. From there, the impurities and lost fibers are carried off via a suction opening by an air current which traverses the waste collection chamber and is drawn from the outside. However, in these known means, the fibers placed at a bias or angle on the suction opening can form a kind of "sieve" or "grid", on which accumulated impurities can be collected. As a result, the air stream can become suppressed or otherwise choked off within a short time. Furthermore, there is the danger that the fibers in the region of the separating opening may also be separated from the opening roll and no longer be brought back onto the opening roll by the secondary air sucked tangentially to the opening roll.

U.S. Pat. No. 3,892,063 describes a device in which separated impurities are also transported tangentially into a tubular suction duct adjacent to a separating opening and reflected by a wall of the duct into a suction duct. A secondary air duct connects the supporting room with the suction duct so that air can enter via the separating opening in such a manner that a separation of fibers is prevented as far as possible.

Both of the known devices require large amounts of suction air and thus imply high power consumption. Also, due to high air current speeds of the air passing in front of the cleaning opening, there is a danger that fibers may be pulled out along with the impurities and thus not only cause blocking of the suction duct as mentioned above but also become lost for further processing.

Accordingly, it is an object of the invention to provide a simple means of eliminating impurities from fibers being processed in an open-end spinning machine which requires a minimum of suction air and a minimum of design complication.

It is another object of the invention to obtain a trouble-free elimination of the impurities and occasional unavoidable lost fibers which arise during operation of an open-end spinning machine.

It is another object of the invention to recover as many lost fibers as possible carried along with separated impurities from an opening roll of an open-end spinning machine for return to the opening roll.

Briefly, the invention provides a method and apparatus for eliminating impurities from fibers being processed in an open-end spinning machine.

The method particularly eliminates the impurities which are separated at an opening roll of the machine and includes the steps of drawing a slow moving stream of air through a duct within the machine into a suction duct, directing the separated impurities from the opening roll through a separating opening into the stream of air to traverse the air stream at an angle of less than ninety degrees, and thereafter deflecting the impurities in the direction of flow of the air stream towards the suction duct. In this way, the impurities and any lost fibers move across the slow moving air stream while being vectored in the direction of air flow.

In addition, the method includes a step of accelerating the air stream after the impurities are deflected. In this way, the deflected impurities can be rapidly withdrawn through the suction duct and out of the machine. At the same time, any loose fibers in the air stream may be stretched out and also rapidly withdrawn before coming to rest against the walls of the ducts.

The apparatus of the invention is associated with a fiber opening means, such as a rotatable opening roll of an open-end spinning machine and includes a duct which extends in close vicinity to the opening means with a wall opposite the opening means. In addition, a separating opening is located between the opening means and the duct to permit passage of impurities from the opening means into the duct. This opening includes a wall, the projected plane of which forms an acute angle with the wall of the duct. In this way, the impurities are directed into an air flow in the duct with a vector in the direction of air flow.

These and other objects and advantages of the invention will become more apparent from the following detailed description and appended claims taken in conjunction with the accompanying drawing in which:

The drawing illustrates a cross-sectional view of a sliver opening mechanism of an open-end spinning machine made in accordance with the invention.

Referring to the drawing, the open-end spinning machine includes a fiber opening means in the form of a rotatable opening roll 1 provided with needles or with clothing and a rotatable feed roll 2 which are arranged in a hollow space 3 of a housing 4 of the open-end spinning machine. The feed roll 2 serves to feed a fiber sliver 5 to the opening roll 1 which rotates at a relatively high speed (about 7,000 r.p.m.) to open the delivered fiber sliver 5 into individual fibers. A duct 6 connects the space 3 to a spinning rotor 7 which is under the influence of a vacuum so that the fibers carried on the opening roll 1 can be conveyed via the duct 6 into the rotor 7 and spun into a yarn.

The hollow space 3 is thus subject to the vacuum via the duct 6.

The housing 4 is also provided with a means for eliminating impurities from the fiber on the opening roll 1. To this end, this means includes an air duct 9 in the housing 4 which communicates the outside air with the space 3 and which is of round or rectangular cross-section. The duct 9 is multi-sectional as explained below and is located opposite to and at a small distance from the opening roll 1. A separating opening 10 communicates the space 3 with the duct 9. The duct 9 merges into a suction duct 11 within the housing 4 in which a vacuum prevails.

As shown, the air duct 9 is multi-sectional. At the inlet end, the duct 9 has a widened section located opposite to the opening roll 1 so that a flow of air may flow through at a relatively low speed. At an intermediate location, the duct 9 has a narrowed section adjacent and downstream of the widened section and thereafter has a tapering section which leads to the suction duct 11. The tapering section is gradually reduced in cross-section to allow the air flow to be accelerated for entry into the suction duct 11.

The duct 9 has a wall 12 opposite the separating opening 10 while the separating opening 10 has a pair of opposed walls 13, 17. The projected plane *t* of the wall 13, shown as an upper wall, forms an acute angle $\beta$ with the wall 12 of the duct 9. The other wall 17 of the opening 10 forms an angle $\gamma$ with a second wall 19 of the air duct 9 which is smaller than the angle $\beta$.

The plane *t* which extends from the opening wall 13 is straight and forms the outermost limit of a trajectory on which impurities 14 thrown off from the opening roll 1 at the separating opening 10 fly across the duct 9. The lower limiting wall 17 of the separating opening 10 is arranged under such an angle with respect to the wall 19 of the duct 9 that no impurities leaving the separating opening 10 can hit the wall 17 but can traverse the duct 18 formed by the walls 13 and 17 unhampered. The widened section of the air duct 9 which is located in front of the separating opening 10 is considerably wider, in such a manner that ideal conditions are created for an aspirating air flow to create a transporting air stream 15 toward the duct 9 in order to carry off the impurities 14 and a suction air stream 16 for transporting regular fibers, which undesirably have been separated back to the opening roll 1.

As shown, the tapering section of the air duct 9 forms an angle $\alpha$ with the widened portion of the duct 9 which angle is less than 45°.

The impurities 14 eliminated at the separating opening 10 are eliminated according to the method described as follows. Upon opening the fiber sliver 5 into individual fibers, but before reaching the separating opening 10, the fibers together with impurities 14, such as sand particles, seed particles and other particles, present in the fiber sliver 5 are located at the circumference of the opening roll 1. While passing the separating opening 10, the impurities 14, owing to their density which is greater than the density of the fibers, are thrown under the influence of centrifugal force via the separating opening 10 across the air duct 9 onto the wall 12 and are reflected there. Due to the characteristic that the angle formed by the wall 12 and the projected plane *t* of the wall 13 is an acute angle, i.e. is not larger than 90°, the impurities 14 which hit the wall 12 are deflected in such a manner as to fly on in the duct 9 in the direction of the transporting air stream 15. As the duct 9 is tapered considerably, the transporting air stream 15 sucked in via the suction duct 11 is accelerated so much that impurities, or fibers separated in another manner, are taken over by the accelerated current, are oriented lengthwise, stretched out and are sucked off before they can extend across the duct 9 in such a manner that an accumulation of separated matter could cause blocking of the suction duct 11.

Due to the great differences of air speeds in the air duct 9 and after the tapered section of the duct 9, a number of conditions prevail. That is, in the widened duction section upstream from the separating opening 10, a low air current speed prevails. Thus, any fibers separated via the separating opening 10 together with the impurities 14 are forced back to the opening roll 1 due to the aspirating air stream 16 created by the vacuum prevailing in the space 3 around the opening roll 1 and are not carried on into the suction duct 11. Further, any fibers which remain separated are oriented by the accelerating transporting air stream 15 in the longitudinal direction, are stretched out and are sucked off. Due to the small duct cross section after the tapered duct section, a minimum quantity of suction air is required to ensure troublefree function of the apparatus.

The invention thus provides a means of removing impurities from the fibers being processed in an open-end spinning machine which requires a minimum of outside air to remove the impurities.

What is claimed is:

1. A method of eliminating impurities separated at an opening roll of an open-end spinning machine, said method comprising the steps of drawing a slow moving stream of air through a duct in the open end spinning machine into a suction duct within the spinning machine, directing the separated impurities from the opening roll through a separating opening between the opening roll and duct into said stream of air to traverse said air stream at an angle of less than 90°; and thereafter deflecting the separated impurities in said air stream in the direction of flow of said air stream towards the suction duct.

2. A method as set forth in claim 1 which further comprises the step of accelerating said air stream after the separated impurities are deflected.

3. A method of eliminating impurities separated at an opening roll of an open-end spinning machine, said method comprising the steps of passing a stream of air through a duct in the open-end spinning machine located adjacent the opening roll;

directing the separated impurities from the opening roll into said stream of air to traverse said stream of air at an angle of less than 90°; and thereafter deflecting the separated impurities in said stream of air in the direction of flow of said stream of air.

4. A method as set forth in claim 3 which further comprises the step of accelerating said stream of air with the reflected impurities therein while directing said stream of air out of the spinning machine.

5. In an open-end spinning machine, the combination of a fiber opening means for opening fibers;

a duct extending in close vicinity to said opening means, said duct having a first wall opposite said opening means; and a separating opening located between said opening means and said duct to permit passage of impurities from said opening means into said duct, said opening having a second wall the projected plane of which forms an acute angle with said wall of said duct.

6. The combination as set forth in claim 5 wherein said duct is reduced in cross-sectional area in the region of said separating opening.

7. The combination as set forth in claim 6 wherein said duct is tapered in said region at a tapering angle smaller than 45°.

8. The combination as set forth in claim 6 wherein said separating opening includes a lower limiting wall opposite said second wall forming an angle which is smaller than said acute angle with a second wall of said duct opposite said first wall.

9. An open-end spinning machine comprising a housing;

a rotatable fiber opening roll within said housing for opening a fiber sliver delivered thereto;

a rotatable feed roll within said housing for feeding a fiber sliver to said opening roll;

a multi-sectional duct within said housing for a flow of air having a widened section located opposite said opening roll, a narrowed section adjacent and downstream of said widened section and a tapering section downstream of said narrowed section;

a separating opening between said opening roll and said widened portion of said duct to permit passage of impurities from fibers on said opening roll into said widened portion of said duct; and a suction duct connected to said tapering section of said multi-sectional duct for withdrawing the flow of air and impurities from said multi-sectional duct.

10. An open-end spinning machine as set forth in claim 9 wherein said widened portion of said duct includes a first wall opposite said separating opening and said separating opening includes a pair of opposed walls the projected plane of one of said opposed walls forming an acute angle with said wall of said widened portion.

11. An open-end spinning machine as set forth in claim 10 wherein said widened portion has a second wall opposite said first wall and said other of said opposed walls of said separating opening forms an angle with said second wall smaller than said acute angle.

* * * * *